US010086220B2

(12) United States Patent
Dolan et al.

(10) Patent No.: US 10,086,220 B2
(45) Date of Patent: Oct. 2, 2018

(54) PROTECTIVE BREATHING MASK WITH FABRIC HOOD

(71) Applicant: Scott Health & Safety LTD, Lancashire (GB)

(72) Inventors: Kevin Dolan, Lancashire (GB); Neale Osmond, Lancashire (GB)

( * ) Notice: Subject to any disclaimer, the term of this patent is extended or adjusted under 35 U.S.C. 154(b) by 716 days.

(21) Appl. No.: 14/082,667

(22) Filed: Nov. 18, 2013

(65) Prior Publication Data

US 2014/0144430 A1 May 29, 2014

Related U.S. Application Data

(63) Continuation of application No. PCT/GB2012/051084, filed on May 16, 2012.

(30) Foreign Application Priority Data

May 16, 2011 (GB) ..... 1108199.9

(51) Int. Cl.
*A62B 17/04* (2006.01)
*A62B 18/08* (2006.01)
(Continued)

(52) U.S. Cl.
CPC ..... *A62B 17/04* (2013.01); *A62B 7/12* (2013.01); *A62B 18/084* (2013.01); *A41D 13/1161* (2013.01)

(58) Field of Classification Search
CPC ..... A62B 17/04; A62B 7/12; A62B 18/084; A41D 13/1161
(Continued)

(56) References Cited

U.S. PATENT DOCUMENTS 1,364,104 A * 1/1921 Geer ..... A62B 18/00 128/201.23
5,146,636 A * 9/1992 De La Pena ..... A62B 17/04 128/201.25
(Continued)

FOREIGN PATENT DOCUMENTS

CN 101873876 A 10/2010
WO 93/14819 A1 8/1993
(Continued)

OTHER PUBLICATIONS

Notification of Reexamination, issued in corresponding Chinese Application No. 201280024022.0 dated Feb. 22, 2017, and English language translation consisting of 13 pages.
(Continued)

*Primary Examiner* — Gregory Anderson
*Assistant Examiner* — Margaret Luarca

(57) ABSTRACT

A protective breathing mask assembly comprises a face mask portion 10 having a brow support 5 at the top thereof which, in use, extends around the brow of the wearer, and a face seal 6 which extends around the back edge of the mask portion 10 so as, in use, to engage around the sides of the wearer's face to prevent the ingress of material into the mask portion. The mask assembly further includes a rear of head strap 4 which extends between the ends of the brow support 5, in use, around the back of the wearer's head. A crown strap 2 is connected to opposing sides of the mask assembly so as, in use, to extend across the top of the wearer's head in opposing relation to the face seal 6, thereby pulling the face seal up against the wearer's face. A head panel 1 extends between and is connected to the crown strap 2 and the rear of head strap 4 so as to be diametrically opposite to the face seal 6, and a hood 11 extends from the brow support 5 rearward over the head panel 1 so as, in use, to enclose the wearer's head and protect against exposure to hazardous
(Continued)

material whereby, in use, the head panel 1 engages the top of the wearer's head so as to properly locate the assembly on the wearer's head.

19 Claims, 4 Drawing Sheets

(51) Int. Cl.
*A62B 7/12* (2006.01)
*A41D 13/11* (2006.01)

(58) Field of Classification Search
USPC ..... 128/201.22, 201.23
See application file for complete search history.

(56) References Cited

U.S. PATENT DOCUMENTS 5,394,568 A * 3/1995 Brostrom ..... A62B 18/084 128/207.11
5,517,986 A * 5/1996 Starr ..... A61M 16/06 128/201.23
6,328,031 B1 * 12/2001 Tischer ..... A62B 17/04 128/201.22
7,735,156 B2 * 6/2010 VanDerWoude ... A41D 13/1153 2/171.3
2010/0037891 A1 * 2/2010 Walker ..... A62B 17/04 128/201.23
2010/0263671 A1 10/2010 Williams

FOREIGN PATENT DOCUMENTS

WO 2009/045954 A1 4/2009
WO 2009/070403 A1 6/2009

OTHER PUBLICATIONS

"Personal Protective Equipment Technology" (Kia Yi, etc., published on Jan. 2008, Part II (3) in Chapter 3) consisting of 3 pages.

* cited by examiner

PROTECTIVE BREATHING MASK WITH FABRIC HOOD

CROSS-REFERENCE TO RELATED APPLICATIONS

This application is a continuation of International Application No. PCT/GB2012/051084 filed May 16, 2012, which claims priority to GB Application No. 1108199.9 filed May 16, 2011, the contents of both of which are incorporated by reference.

BACKGROUND OF THE INVENTION

Positive pressure breathing systems operate by delivering breathing gas into a mask so as to maintain a positive pressure therein. The pressure inside the mask then prevents hazardous particles from entering into the breathing atmosphere within the mask from the surroundings.

Positive pressure breathing masks are known in the art which incorporate a fabric hood which extends over the users head to protect against breathing in hazardous particles. Due to the manner in which the positive pressure within the mask prevents particles from the surrounding environment from entering the breathing atmosphere within the mask, the fabric hood typically has only an elastic seal to hold it in place around the users head.

One prior art such hooded mask is a one size fits all design in which the hood simply extends from the top of the mask rearward with an elasticated bottom which grips around the wearer's head. The hood then protects the users head from hazardous material and also guards the top of the mask to prevent hazardous particles entering into the mask area. Variants of this prior art design also include a neck cap which extends down over the wearer's neck and shoulders to extend the protection afforded by the mask.

The manner in which the hood is secured to the users head plays and important role in user protection and comfort. A good seal is required around the face and head to prevent contaminants entering the hood during breathing. The problem, however, is that the human head varies in shape and size, and this presents a challenge when designing a one size fits all solution—the hood should be able to adapt to different head and face shapes, as well as being able to provide good seal tension on small head sizes whilst not being uncomfortably tight on large head sizes.

The known prior art solves this problem by use of an elasticated head net which is provided inside the hood and extends rearward from a brow support, together with a neoprene face seal. This system improves user protection and comfort, being able to adapt to a wide variety of head shapes and sizes whilst maintaining the highest respiratory protection standard. However, the tension which retains the mask on the head only resolves to pull the face seal vertically onto the wearer's face, so that the effectiveness of the seal is limited.

SUMMARY OF THE PRESENT INVENTION

The present invention relates to breathing masks and more particularly to breathing masks which incorporate a fabric hood that extends over the head of the wearer to protect against breathing in hazardous particles.

BRIEF DESCRIPTION OF THE DRAWINGS

The accompanying drawings, which are incorporated herein and constitute part of this specification, illustrate exemplary embodiments of the invention, and together with the description above, serve to explain further features of the invention.

DETAILED DESCRIPTION OF THE INVENTION

Figure 1:
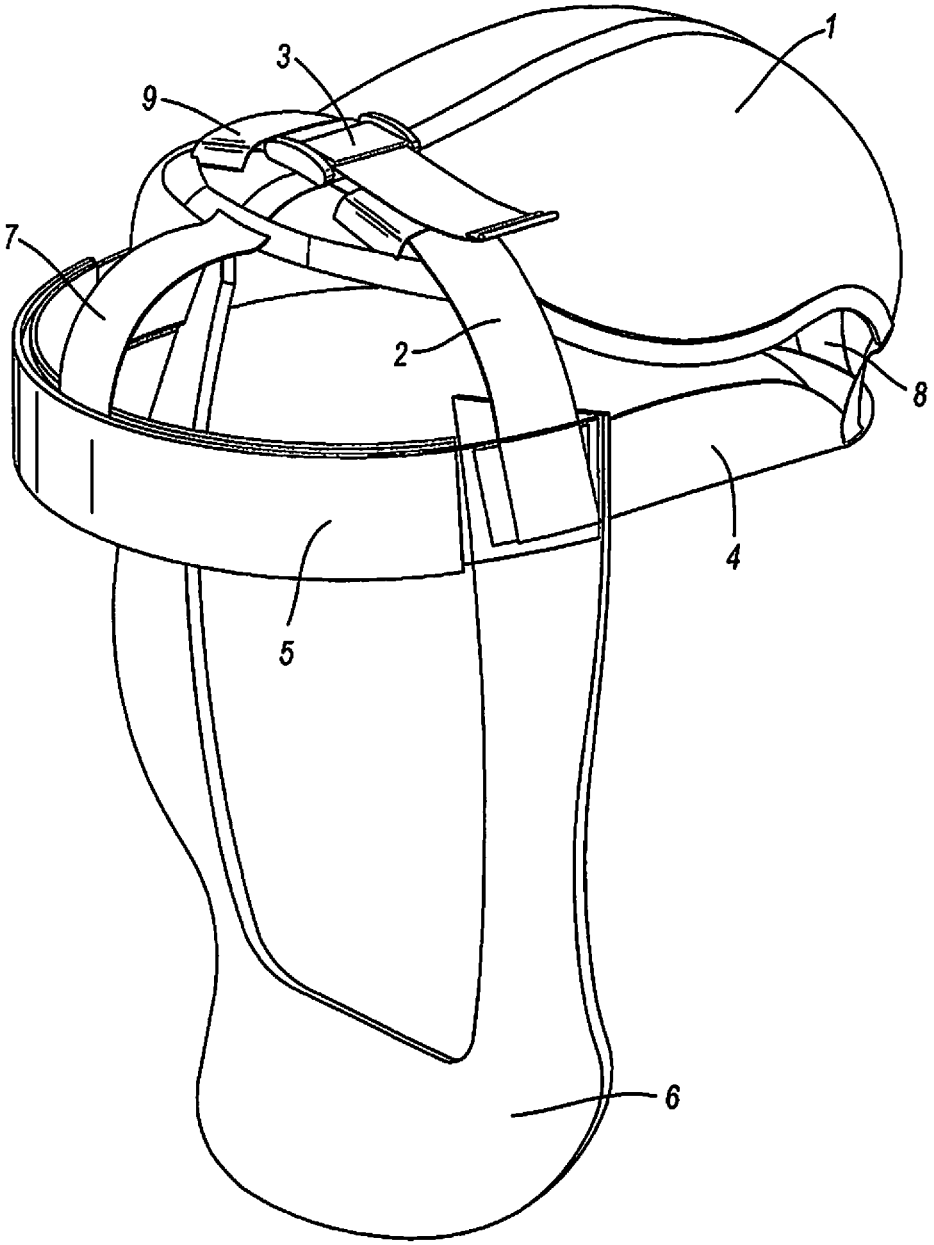
FIG. 1 is a front perspective view of the internal mounting system of a mask according to the invention.

According to the present invention there is provided a protective breathing mask assembly comprising a face mask portion (10) (also referenced herein as a "visor") having a brow support (5) at the top thereof which, in use, extends around the brow of the wearer, and a face seal (6) which extends around the back of the mask portion so as, in use, to engage around the sides of the wearer's face to prevent the ingress of material into the mask portion, wherein the mask assembly further includes a rear of head strap (4) which extends between the ends of the brow support (5), in use, around the back of the wearer's head, a crown strap (2) which is connected to opposing sides of the mask assembly so as, in use, to extend across the top of the wearer's head in opposing relation to the face seal (6), thereby pulling the face seal (6) up against the wearer's face; a head panel (1) which extends between and is connected to the crown strap (2) and the rear of head strap (4) so as to be diametrically opposite to the face seal (6) and is positioned beneath the crown strap (2); and a hood (11) which extends from the brow support (5) rearward over the head panel (1) so as, in use, to enclose the wearer's head and protect against exposure to hazardous material; whereby, in use, the head panel (1) engages the top of the wearer's head so as to properly locate the assembly on the wearer's head.

A protective breathing mask assembly in accordance with the invention has the advantage that the provision of the head panel (1) in diametric opposition to the face seal (6) operates to pull the face seal (6) up and back, rather than just up as was the case with the prior art systems, thereby improving the effectiveness of the seal.

Preferably, the hood (11) is a flexible hood, in particular a fabric hood, and it advantageously has an air inlet opening (13) at the rear thereof to which is connectable an inlet hose of a breathing air supply means such that breathing air is supplied into the back of the hood (11). This has the advantage that the air will tend to inflate the hood (11), making it more comfortable, and also the movement of air across the head of the wearer will help to help to keep the wearer cool.

The rear of head strap (4) and crown strap (2) are preferably elastic so as to accommodate heads of different sizes and shapes. However, they may alternatively or even additionally be adjustable by means of buckles, hook and loop material fastening systems or the like.

The head panel (1) is preferably made of net fabric and is shaped to the typical contour of a wearer's head.

Preferably, the head panel (1) is attached at one end to the brow support (5), preferably adjustably connected and in particular connected by adjustable straps. The head panel (1) is preferably attached at its back end to the rear of head strap (4), in particular by elastic straps.

The front attachment of the head panel (1) to the brow support (5) is preferably achieved by means of at least one strap extending to the front of the brow support (5) and at least one strap extending to either side of the brow support (5).

An important aspect of the invention is the connection of the head panel (1) at the back of the hood (11), as this enables the apparatus to be fitted by the wearer hooking the apparatus onto the front of the head and them pulling down over the back of the head, the connection of the head panel to the back of the hood/rear strap enabling the back of the head panel to be pulled back over the head.

The present invention offers an intuitive to don system, that can adapt to a wide variety of head size and shapes whilst maintaining maximum respiratory protection. Comfort has also been improved through spreading seal tension loads. In particular, the present invention offers the advantages of Improved head and face seal performance; One size fits all solution; Improved hood security; Improved user comfort; Easier/more intuitive to don.

In a preferred improvement to the present invention; the face seal (6) is formed through using a flat sheet of neoprene that is cut into a 'U' shape. When this is stitched into the hood (11) it forms an adaptable seal that can bend and flex to the shape of any face. To ensure good contact is made with the face an elastic strap is preferably attached to the top ends of the neoprene panel that runs over the crown of the head. When the hood (11) is donned this elastic strap stretches which applies a tension into the neoprene creating a good seal. The stretch of the elastic strap and flexibility of the neoprene face seal means that it can stretch to different sized heads, in order for the seal to remain comfortable on large head sizes it can be adjusted in length through a buckle (3) to reduce tension, the opposite can also be done by shortening the elastic for smaller head sizes in order to maintain a good face seal tension.

In order to position this elastic strap in the correct position across the crown of the head it is attached to the head assembly. The head panel (1) is attached to the brow support (5) and rear of head strap (4), which preferably forms an elastic seal, through a series of short elastic lengths. These prevent the head panel from sitting too far forward or backward on top of the head. The large surface area of the head panel provides good grip which improves the security of the overall hood, this system also keeps the elastic straps in their optimal position to provide tension into the head and face seals, a third benefit of the larger surface area is to spread the load of the elastic tensions across a wider area therefore improving comfort.

A common problem with currently available hoods is the complexity of donning the hood correctly so the user gets maximum protection, floating brow pads, crown straps and harnesses can be tricky to align during the donning process. The head panel system of the present disclosure simplifies donning by connecting everything together. The user can see immediately where to position their head, and once in place the head and face seals can be pulled down and donning is complete without the need for aligning any straps.

With particular reference to the illustrations, in FIG. 1 there is shown a breathing mask harness assembly which forms part of the breathing mask assembly according to the invention. The neoprene face seal (6) attaches around the edge of visor (10) so as to form a fluid tight seal therewith. The face seal (6) engages the sides of the face and under the chin of a wearer to protect the wearer from harmful particles in the surrounding atmosphere.

As shown in the figure, adjustable length elastic crown strap (2) extends between the upper ends of the face seal (6) on each side of the assembly and links with head panel (1) which is located to engage with the top of a wearer's head. The crown strap (2) includes a buckle (3) by means of which the length of the crown strap (2) can be adjusted to accommodate different head sizes and shapes.

Figure 2:
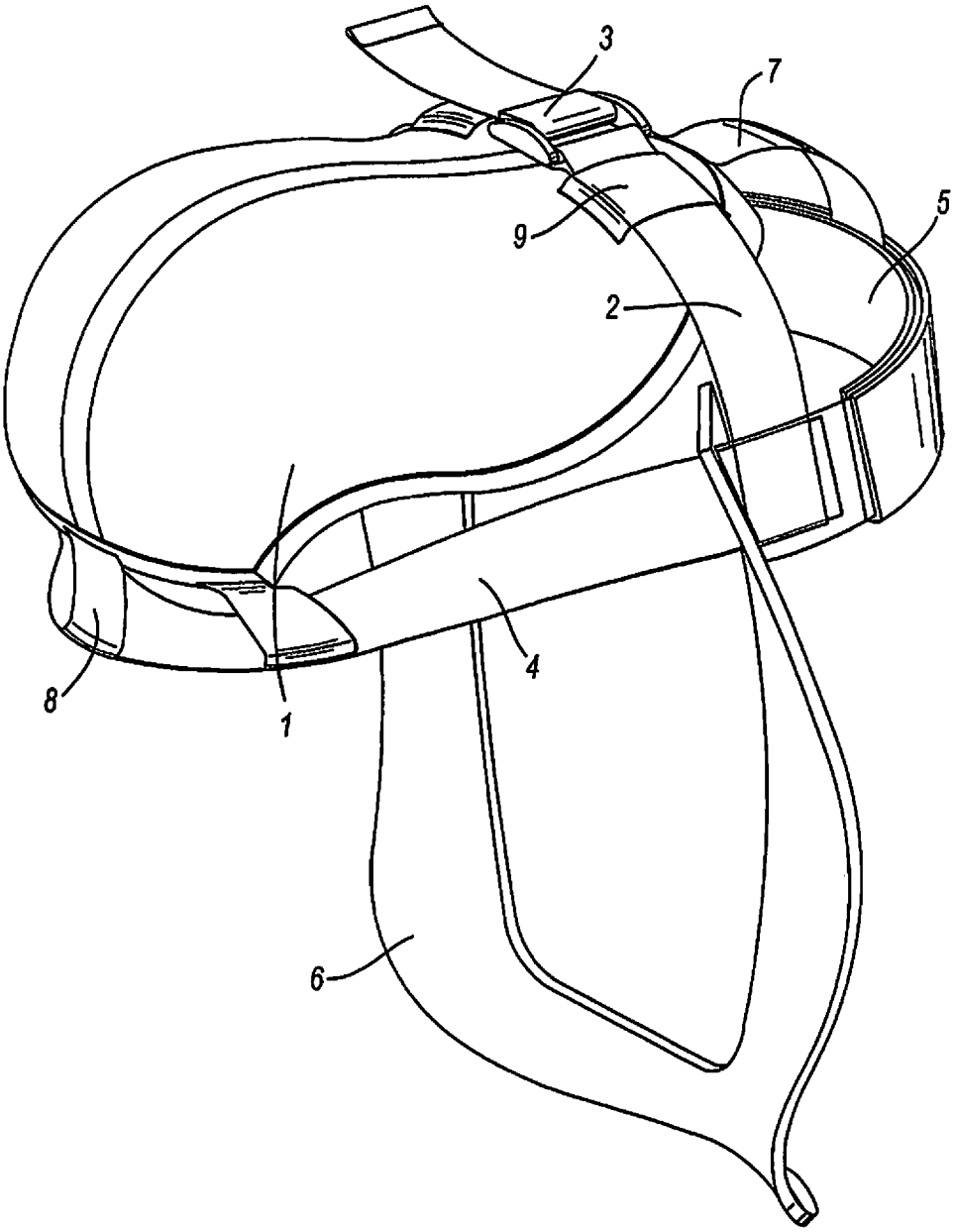
FIG. 2 is a rear perspective view of the mounting system of FIG. 1.
Figure 3:
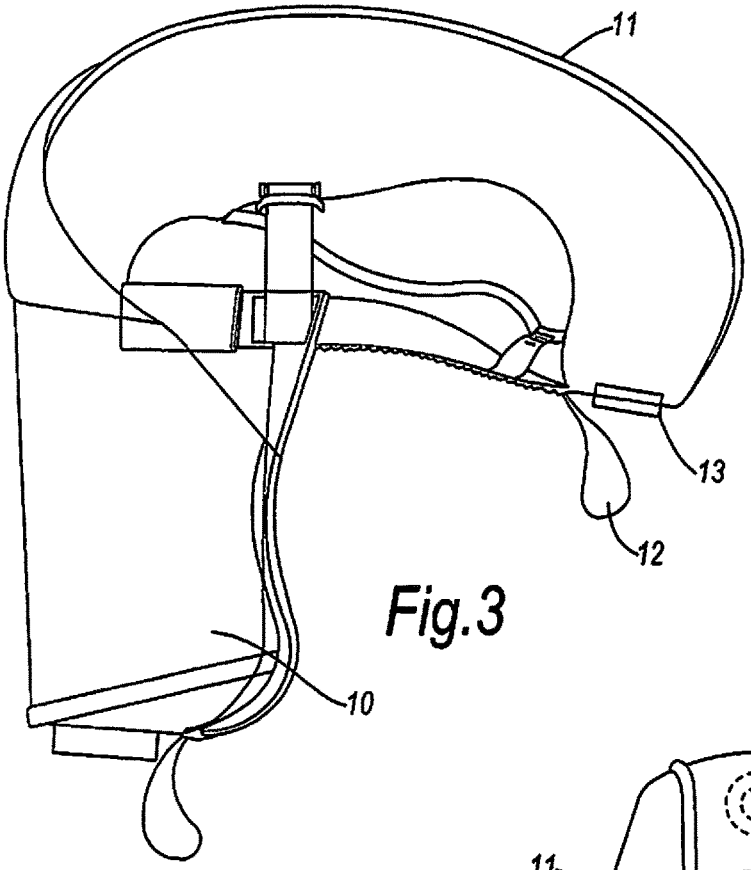
FIG. 3 is a side view of the mounting system of FIG. 1 with a hood and mask overlaid.

Brow support (5) as shown is indirectly connected to the ends of the face seal (6) and extends forward of the face seal (6) so as, in use, to engage against and around the brow of the wearer and thereby locate the assembly relative to the wearer's face. By "indirect" it is meant that the brow support (5) is interconnected with the face seal (6) by having direct attachment with the rear of head strap (4) and/or by having direct attachment with the crown strap (2), as shown in FIGS. 1-3, wherein the rear of head strap (4) is interconnected with the face seal (6). The brow support (5) preferably has a toweling sweat pad provided on the inner surface thereof.

Extending rearward from the ends of the brow support (5) is a rear of head elastic strap/seal (4), which, in use, extends around the back of the wearer's head so as to secure the mask in place on the wearer's head and also seal the back of the mask against the ingress of harmful materials and particles. As illustrated in the figures, the rear of head strap (4) is preferably threaded through openings in each of the upper ends of the face seal (6), wherein front ends of the rear of head strap (4) engage the rear ends of the brow support (5) as well as the ends of crown strap (2), whereby each of the brow support (5) and crown strap (2) are indirectly connected to each of the ends of face seal (6). Preferably, the rear of head strap engages the face seal but is preferably not attached to the face seal. Preferably, the ends of each of the crown strap (2), rear of head strap (4) and brow support (5) are attached to each other, as illustrated in each of the figures.

Head panel (1) is shaped to fit the general shape of the top of a wearer's head and extends from the crown strap (2) rearward to the back of the harness so that, in use, it engages with and overlies the top and back of the wearer's head. The head panel (1) has a pair of crown strap positioning straps (9) on the front end thereof located symmetrically on either side of the center line of the head panel (1) through which the crown strap (2) is fed so as to attach the head panel (1) to the crown strap (2) as shown in FIG. 1.

The head panel (1) also has three elasticated rear positioning straps (8) extending from its back edge and one elasticated front positioning strap (7) extending from its front edge. The rear positioning straps (8) are attached to the rear of head strap (4) so as to secure the back of the head panel (1) in relation to the back of the harness. As seen in FIGS. 1 and 2, the rear position straps (8) are permanently attached to the rear of head strap (4), but they may alternatively have loops formed in them through which the rear of head strap (4) is fed. Similarly, the front positioning strap (7) is attached to the middle of the brow support (5) so as to locate the front of the head panel (1) in relation to the crown strap (2). This may likewise be a permanent fastening or a releasable fastening such as by means of a buckle, hook and loop fastening material, or a loop formed in the front positioning strap (7) through which the crown strap (2) is fed or the like.

Figure 4:
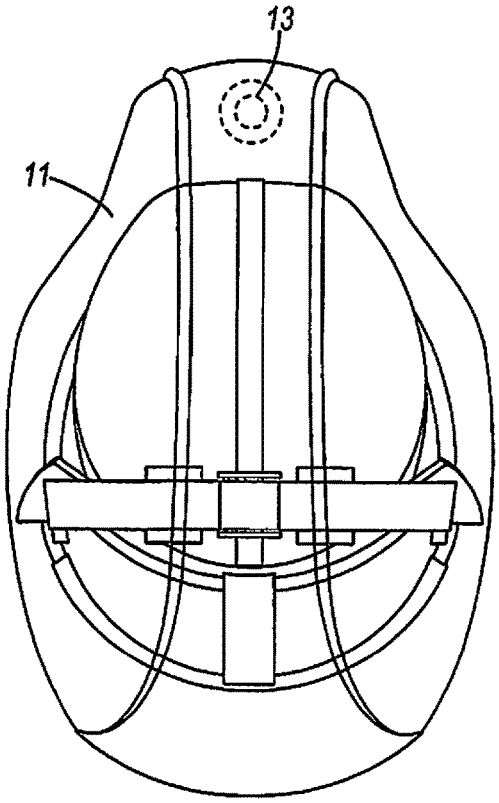
FIG. 4 is a top view of the mask of the invention.

As illustrated in FIG. 3, the harness assembly is covered by a hood (11) which is fastened to the top of the mask (10) and also to the rear of head strap (4). The harness is then located within the mask assembly by means of the attachment of the face seal (6) to the mask and attachment of the rear of head strap (4) to the hood (11). As seen in FIG. 3 and FIG. 4, a coupling (13) (i.e. air inlet opening) is provided in the back of the hood at the bottom for attaching an air delivery hose (not shown) for delivering breathing air to the inside of the mask assembly.

The interconnection of the various components of the mask assembly simplifies fitting and removal of the mask as compared with prior art systems. The mask is fitted by a wearer inserting their head through the opening in the bottom of the mask so that the forehead engages against the brow support. The rear of the assembly is then simply pulled over the back of the head using the convenient pulling eye (12).

Figure 5:
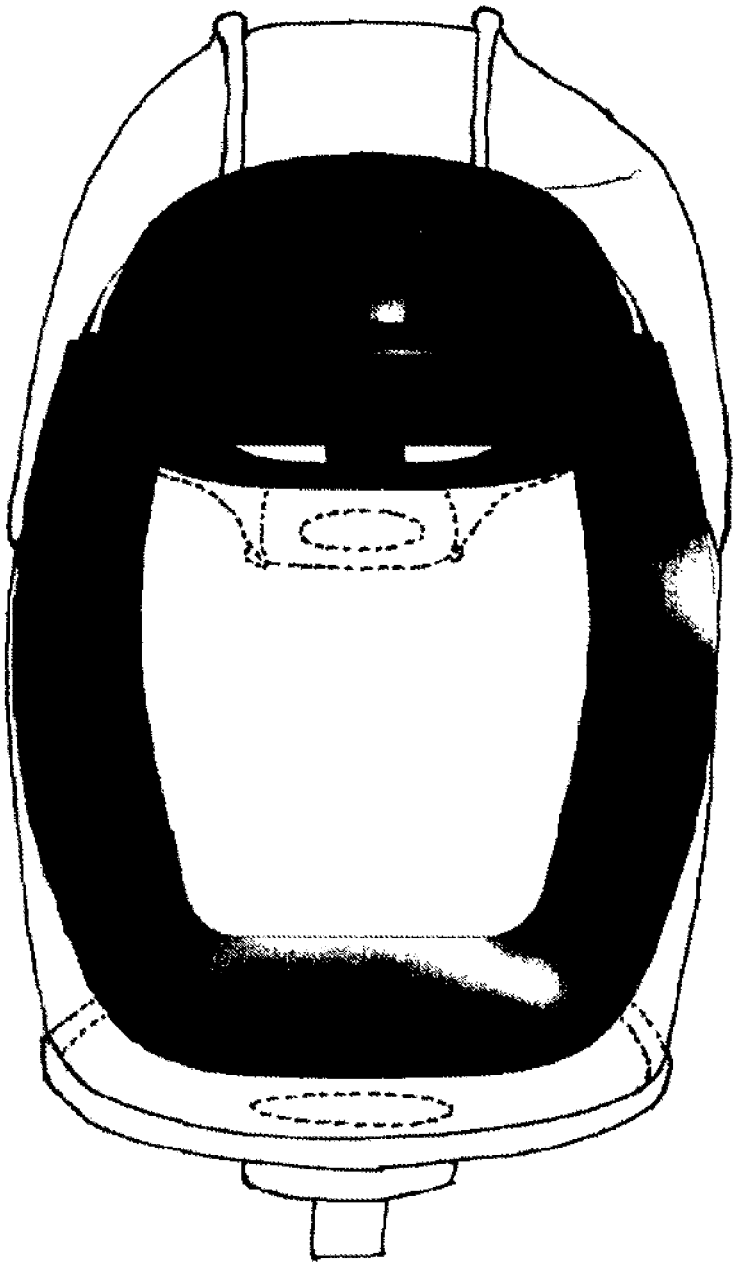
FIG. 5 is a front-view schematic representation of the mask assembly of FIG. 3.

As illustrated in FIG. 5 and viewed together with FIG. 3, the bottom of the face mask/screen (10) extends inwardly toward the face seal (6), such that the face mask/screen (10) extends below the brow support (5) when the mask assembly is in an upright position, and whereby the face seal (6) engages the back of the face mask/screen portion (10) behind the brow support (5), preferably only behind the brow support (5). This bottom portion of the face mask/screen portion (10) is preferably transparent and also preferably includes an opening that allows exhaled air to exit the sealed mask assembly.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A protective breathing mask assembly comprising:

a face mask portion having:

a brow support at the top of the face mask portion, the brow support having a first end and a second end opposite the first end, the brow support being configured to extend around the brow of a wearer when the protective breathing mask assembly is in use; and a face seal extending around a portion of the back of the face mask portion such that the face seal is configured to engage around the sides of the wearer's face to prevent the ingress of material into the face mask portion when the protective breathing mask assembly is in use, the face seal having a 'U' shape with a first upper free end and a second upper free end, the second upper free end being a distance from the first upper free end, each of the first and second upper free ends having an aperture; and a rear of head strap having a first end and a second end opposite the first end, the rear of head strap first end being threaded through the aperture of the first upper free end and then being attached to the brow support first end, and the rear of head strap second end being threaded through the aperture of the second upper free end and then being attached to the brow support second end such that the rear of head strap extends between the first and second ends of the brow support, the rear of head strap being configured to extend around the back of the wearer's head when the protective breathing mask assembly is in use;

a crown strap configured to extend over the crown of the wearer's head between the first and second upper free ends of the face seal when the protective breathing mask assembly is in use, the crown strap being connected to opposing sides of the mask assembly such that the crown strap is configured to extend across the top of the wearer's head in opposing relation to the face seal when the protective breathing mask assembly is in use, thereby pulling the face seal up against the wearer's face;

a head panel positioned beneath the crown strap, the head panel extending between and being directly attached to each of the crown strap and the rear of head strap so as to be diametrically opposite to the face seal; and a hood extending from the brow support rearward over the head panel such that the hood is configured to enclose the wearer's head and protect against exposure to hazardous material when the protective breathing mask assembly is in use, the head panel being configured to engage the top of the wearer's head so as to properly locate the assembly on the wearer's head when the protective breathing mask assembly is in use.

2. A protective breathing mask assembly according to claim 1, wherein the hood is a flexible fabric wherein the hood and the face mask portion are overlaid.

3. A protective breathing mask assembly according to claim 1, wherein the hood has an air inlet opening at the rear thereof to which is connectable an inlet hose of a breathing air supply means such that breathing air is supplied into the back of the hood.

4. A protective breathing mask assembly according to claim 1, wherein the rear of the head strap and the crown strap are at least one of elasticated and adjustable using buckles, hook and loop material fastening systems so as to accommodate heads of at least one of different sizes and shapes.

5. A protective breathing mask assembly according to claim 1, wherein the head panel is made of net fabric.

6. A protective breathing mask assembly according claim 1, wherein the head panel is attached at the front end to the brow support, and at the back end to the rear of head strap.

7. A protective breathing mask assembly according to claim 6, wherein the front attachment of the head panel to the brow support is achieved using at least one strap extending to the front of the brow support and at least one strap extending to either side of the brow support.

8. A protective breathing mask assembly according to claim 1, wherein the face seal is formed from a flat sheet of neoprene that is cut into the 'U' shape and fastened to the hood so as to form an adaptable seal that can bend and flex to the shape of any face.

9. The protective breathing mask assembly of claim 1, wherein the face mask includes a bottom portion that extends inwardly toward the face seal such that the face mask extends below the brow support when the mask assembly is in an upright position.

10. The protective breathing mask assembly of claim 9, wherein the bottom portion of the face mask is transparent.

11. The protective breathing mask assembly of claim 9, wherein the bottom portion of the face mask includes an opening that allows exhaled air to exit the mask assembly.

12. The protective breathing mask assembly of claim 1, wherein the face seal engages the back of the face mask portion behind the brow support.

13. The protective breathing mask assembly of claim 1, wherein the face seal engages the back of the face mask portion only behind the brow support.

14. The protective breathing assembly of claim 1, wherein the rear of head strap engages the face seal but is not attached to the face seal.

15. The protective breathing mask assembly of claim 1, wherein the brow support is indirectly connected to the face seal.

16. The protective breathing assembly of claim 1, wherein the crown strap is indirectly connected to the face seal.

17. The protective breathing assembly of claim 1, wherein the brow support and crown strap are both indirectly connected to the face seal, and wherein the brow support, crown strap and rear of head strap are attached to each other.

18. The protective breathing assembly of claim 1, wherein the face seal and the hood are indirectly connected to each other.

19. A protective breathing mask assembly comprising:

a brow support, the brow support having a first end and a second end opposite the first end, the brow support, in use, being configured to extend around the brow of a wearer;

a face seal that, in use, is configured to engage around the sides of the wearer's face to prevent the ingress of material into the protective breathing mask assembly, the face seal having a first free end with a first aperture and a second free end with a second aperture;

a rear of head strap which extends between the first and second ends of the brow support such that the rear of head strap, in use, is configured to extend around the back of the wearer's head, the rear of head strap having a first end that is threaded through the face seal first aperture and then is attached to the first end of the brow support and a second end that is threaded through the face seal second aperture and then is attached to the second end of the brow support;

a crown strap which is connected to opposing sides of the mask assembly such that the crown strap, in use, is configured to extend across the top of the wearer's head in opposing relation to the face seal, thereby pulling the face seal up against the wearer's face;

a head panel which extends between and is connected to the crown strap and the rear of head strap so as to be diametrically opposite to the face seal; and a hood which extends from the brow support rearward over the head panel such that the hood, in use, is configured to enclose the wearer's head and protect against exposure to hazardous material, in use, the head panel being configured to engage the top of the wearer's head so as to properly locate the assembly on the wearer's head, the front attachment of the head panel to the brow support being achieved by means of at least one strap extending to the front of the brow support and at least one strap extending to either side of the brow support.

* * * * *